US007575841B2

(12) United States Patent
Daimon et al.

(10) Patent No.: US 7,575,841 B2
(45) Date of Patent: Aug. 18, 2009

(54) TONER FOR ELECTROPHOTOGRAPHY, MANUFACTURING METHOD OF TONER FOR ELECTROPHOTOGRAPHY, DEVELOPER FOR ELECTROPHOTOGRAPHY, AND IMAGE FORMING METHOD

(75) Inventors: Katsumi Daimon, Minamiashigara (JP); Kazufumi Tomita, Minamiashigara (JP); Moegi Iguchi, Minamiashigara (JP); Yasuo Matsumura, Minamiashigara (JP); Yusuke Ikeda, Minamiashigara (JP); Shigeru Hayashi, Minamiashigara (JP); Shuji Sato, Minamiashigara (JP); Takashi Imai, Minamiashigara (JP); Yosuke Tsurumi, Minamiashigara (JP); Hiroshi Nakazawa, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 503 days.

(21) Appl. No.: 11/294,669

(22) Filed: Dec. 6, 2005

(65) Prior Publication Data

US 2007/0048647 A1 Mar. 1, 2007

(30) Foreign Application Priority Data

Aug. 24, 2005 (JP) ..... 2005-243038

(51) Int. Cl.
*G03G 9/087* (2006.01)
*G03G 9/093* (2006.01)

(52) U.S. Cl. ..... 430/109.4; 430/110.2; 430/110.3; 430/123.52; 430/123.54; 430/137.11; 430/137.14

(58) Field of Classification Search ..... 430/109.4, 430/110.2, 110.3, 137.11, 137.14, 123.52, 430/123.54
See application file for complete search history.

(56) References Cited

U.S. PATENT DOCUMENTS

| | | | | |
|---|---|---|---|---|
| 5,672,454 | A * | 9/1997 | Sasaki et al. | 430/110.2 |
| 6,130,018 | A * | 10/2000 | Kawata et al. | 430/111.35 |
| 2004/0132920 | A1 * | 7/2004 | Matsumura et al. | 525/418 |

FOREIGN PATENT DOCUMENTS

| | | |
|---|---|---|
| JP | B 42-023910 | 11/1967 |
| JP | B 56-013943 | 4/1981 |
| JP | A 61-120161 | 6/1986 |
| JP | A 62-047649 | 3/1987 |
| JP | B 62-039428 | 8/1987 |
| JP | A 62-273574 | 11/1987 |
| JP | B 63-025335 | 5/1988 |
| JP | A 02-198457 | 8/1990 |
| JP | A 04-188154 | 7/1992 |
| JP | A 2004-191927 | 7/2004 |

* cited by examiner

*Primary Examiner*—Janis L Dote
(74) *Attorney, Agent, or Firm*—Oliff & Berridge, PLC

(57) ABSTRACT

The present invention provides a toner for electrophotography having a capsule structure including a core and a shell that covers the core, wherein the core contains a colorant, a releasing agent, an amorphous resin, and a block polymer containing a crystalline part and an amorphous part, the weight-average molecular weight of the block polymer is 10,000 or more, the weight-average molecular weight of the resin used in formation of the amorphous part of the block polymer is 1000 to 5000, and the weight-average molecular weight of the resin used in formation of the crystalline part of the block polymer is at least 2 times the weight-average molecular weight of the resin used in formation of the amorphous part of the block polymer, a method of manufacturing the same, a developer for electrophotography including the toner and a carrier, and an image forming method using the developer for electrophotography.

16 Claims, No Drawings

TONER FOR ELECTROPHOTOGRAPHY, MANUFACTURING METHOD OF TONER FOR ELECTROPHOTOGRAPHY, DEVELOPER FOR ELECTROPHOTOGRAPHY, AND IMAGE FORMING METHOD

CROSS-REFERENCE TO RELATED APPLICATION

This application claims priority under 35 USC 119 from Japanese Patent Application No. 2005-243038, the disclosure of which is incorporated by reference herein.

BACKGROUND OF THE INVENTION

1. Field of the Invention

The present invention relates to a toner for electrophotography usable in an electrophotographic apparatus making use of an electrophotographic process such as a copier, printer, or facsimile equipment, a manufacturing method of the toner, a developer for electrophotography using the toner, and an image forming method using the developer.

2. Description of the Related Art

Regarding electrophotography methods, many methods are already known (see, for example, Japanese Patent Application Publication (JP-B) No. 42-23910, the disclosure of which is incorporated by reference herein). Generally, a fixed image is formed after plural steps of electrically forming a latent image on a surface of a photoreceptor (latent image holding member) utilizing a photoconductive substance by a variety of means, developing the formed latent image using a toner for electrophotography (hereinafter, also simply referred to as "toner") to form a toner image, transferring the toner image on the photoreceptor surface onto a surface of a recording material such as paper via or not via an intermediate transfer body, and fixing this transferred image by heating, pressurizing, heating and pressurizing or a solvent steam. Toner remaining on the photoreceptor surface is cleaned by various methods if necessary, and is re-supplied to the aforementioned plural steps.

As a fixing technique for fixing a transferred image which has been transferred onto a surface of a recording material, a thermal roll fixing method of inserting a transfer material onto which a toner image has been transferred between a pair of rolls composed of a heating roll and a pressure roll to fix the image is common. In addition, as a similar technique, a technique in which one or both of the rolls is substituted with a belt is also known. In these techniques, an image that is fixed fast can be obtained at high speed, energy efficiency is high, and damage to the environment due to solvent volatilization or the like is minimal, as compared with other fixing methods.

On the other hand, in order to reduce the amount of energy used in a copier or printer, technology for fixing the toner with low energy is demanded. Hence, there is a strong need for toner for electrophotography capable of fixing at a low temperature.

To lower the toner fixing temperature, a technique for lowering the glass transition point of resin for toner (binder resin) is generally used. However, if the glass transition point is too low, powder aggregation (blocking) is likely to occur, and storability of toner in a fixed image surface is decreased. Thus, from a practical standpoint, the lower limit of the glass transition point is 50° C. This glass transition point is the design point of the resin for toner presently available on market, and the method of lowing the glass transition point is not enough to obtain toner capable of being fixed at lower temperature. Further, although the fixing temperature can be lowered by using a plasticizer, there is a problem since blocking occurs in the developing device or when the toner is stored.

As means for satisfying blocking prevention, image storability at a temperature of up to 60° C., and low temperature fixing performance, it has been proposed to use a crystalline resin as a binder resin in the toner, and it has been known for a long time to use a crystalline resin as toner for the purpose of blocking prevention and low temperature fixing (see, for example, Japanese Patent Application Publication (JP-B) No. 56-13943, the disclosure of which is incorporated by reference herein). Further, the technique of using crystalline resin for the purpose of offset prevention and pressure fixing has been known for a long time (see, for example, JP-B Nos. 62-39428 or 63-25335, the disclosures of which are incorporated by reference herein).

However, by using a crystalline resin alone, the strength of the resin itself is low as compared with an amorphous resin, and there is a problem with respect to powder reliability. In particular, storage at high temperature is difficult, blocking occurs in developing device, and filming is likely to occur on a photoreceptor.

To improve the strength, it is effective to mix a crystalline resin and an amorphous resin, and further it has been attempted not to dispose the crystalline resin on a surface layer by forming a capsule structure (see, for example, Japanese Patent Application Laid-Open No. 61-120161, the disclosure of which is incorporated by reference herein). However, since the covering layer is formed by attaching resin particles to an outer side, it is hard to conceal the crystalline resin completely, and if the covering rate is increased to raise the concealing rate, the crystalline resin cannot moved smoothly to the outer side, and fixing property becomes poor. In other words, it is difficult to satisfy both blocking prevention and low temperature fixing. Besides, if resins are not mixed smoothly, there is a problem in that offset is likely to occur at high temperatures.

As a technology for satisfying both low temperature fixing and blocking resistance, it is known to use a block polymer of a crystalline resin and an amorphous resin (see, for example, JP-A Nos. 62-47649 and 62-273574, the disclosures of which are incorporated by reference herein). As compared with the case of blending two resins, both low temperature fixing and blocking resistance are more likely to be achieved, but if there is no shell layer, even though the block polymer is made from a crystalline resin and an amorphous resin, external additives may be buried in portions (crystalline portions) corresponding to the crystalline resin in the block polymer, and it is difficult to stabilize the image quality for a long period and to maintain high charging property at high temperature and high humidity.

It has also been proposed to form a shell layer in mother particles in which a block polymer is used. For example, there is a method in which mother particles are coated with resin particles by a mechanical method (see, for example, JP-A Nos. 2-198457 and 4-188154, the disclosures of which are incorporated by reference herein). However, since coating layers of these toners are coated only mechanically, they are buried in a base material or shell particles are adhered only on the surface, and thus, they are likely to peel off. In particular, when it is desired to maintain favorable image quality for a long period, there is a problem in that image quality deteriorates due to peeling of shell.

Aside from such manufacturing of toners having a capsule structure by a dry process, recently, toner manufactured by a wet process, and in particular, a toner manufactured by an emulsion aggregation method including adhering latex particles to the core and forming a shell by heating and fusing in water has been proposed (see, for example, JP-A No. 2004-191927, the disclosure of which is incorporated by reference herein). The toner containing a crystalline resin and formed into a capsule structure by the emulsion aggregation method is favorable with respect to low temperature fixing property and is also excellent with respect to toner blocking and image quality maintenance. However, at the time of running at high temperature and high humidity, filming on a photoreceptor may still be observed, and excellent image quality may not be maintained for a long period in some cases. On the other hand, the present technology is not sufficient to withstand storage at high temperature and high humidity, prevent blocking in a developing device, and stably maintain image quality for a long period, while maintaining low temperature fixing property.

SUMMARY OF THE INVENTION

The present invention has been made in view of the above circumstances, and provides a toner for electrophotography capable of maintaining high image quality for a long period while maintaining favorable low temperature fixing property, a manufacturing method of the toner, a developer for electrophotography using the toner, and an image forming method using the developer.

A first aspect of the invention provides a toner for electrophotography having a capsule structure comprising a core and a shell that covers the core. The core contains a colorant, a releasing agent, an amorphous resin, and a block polymer containing a crystalline part and an amorphous part. The weight-average molecular weight of the block polymer is 10,000 or more, the weight-average molecular weight of the resin used in formation of the amorphous part of the block polymer is 1000 to 5000, and the weight-average molecular weight of the resin used in formation of crystalline part of the block polymer is at least 2 times the weight-average molecular weight of the resin used in formation of the amorphous part of the block polymer.

A second aspect of the invention provides a manufacturing method of toner for electrophotography comprising: forming aggregated particles by mixing a colorant particle dispersion, a releasing agent particle dispersion, an amorphous resin particle dispersion, and a block polymer particle dispersion in which particles of a block polymer containing a crystalline part and an amorphous part are dispersed; adhering coating resin particles to the surface of the aggregated particles; and fusing by heating the aggregate particles to which the coating resin particles are adhered, wherein the toner for electrophotography is the toner for electrophotography of the first aspect of the invention.

A third aspect of the invention provides a developer for electrophotography comprising a toner for electrophotography and a carrier. The toner for electrophotography has a capsule structure comprising a core and a shell that covers the core. The core contains a colorant, a releasing agent, an amorphous resin, and a block polymer containing a crystalline part and amorphous part. The weight-average molecular weight of the block polymer is 10,000 or more, the weight-average molecular weight of the resin used in formation of the amorphous part of the block polymer is 1000 to 5000, and the weight-average molecular weight of the resin used in formation of the crystalline part of the block polymer is at least 2 times the weight-average molecular weight of the resin used in formation of the amorphous part of the block polymer.

A fourth aspect of the invention provides an image forming method comprising: forming an electrostatic latent image on a surface of a latent image holding member; developing, by use of a developer carried on a developer carrier, the electrostatic latent image formed on the surface of the latent image holding member to form a toner image; transferring the toner image formed on the surface of the latent image holding member onto a surface of a transfer receiving material; and fixing the toner image transferred onto the surface of the transfer receiving material, wherein the developer is the developer for electrophotography of the third aspect of the invention.

DETAILED DESCRIPTION OF THE INVENTION

The toner for electrophotography of the present invention is a toner having a capsule structure including a core coated with a shell. The core contains a colorant, a releasing agent, and a binder resin. As the binder resin, an amorphous resin and a block polymer containing a crystalline part and an amorphous part are used. Furthermore, the toner satisfies the following conditions (1) to (3).

(1) The weight-average molecular weight of the block polymer is 10,000 or more.

(2) The weight-average molecular weight of the resin used in forming the amorphous part of the block polymer (hereinafter, referred to a resin for amorphous part) is 1000 to 5000.

(3) The weight-average molecular weight of the resin used in forming the crystalline part of the block polymer (hereinafter, referred to a resin for crystalline part) is at least 2 times the weight-average molecular weight of the resin for amorphous part.

The toner of the invention is capable of maintaining favorable low temperature fixing property, withstanding storage at high temperature and high humidity, preventing blocking in developing device, effectively preventing filming on a photoreceptor, and stably maintaining a high quality image for a long period.

Components of the toner for electrophotography of the invention are described specifically below.

<Binder Resin>

As the binder resin of the invention, an amorphous resin and a block polymer containing a crystalline part and an amorphous part are used.

(Block Polymer)

The block polymer used in the invention is first required to have the condition of (1) a weight-average molecular weight of 10,000 or more. If the weight-average molecular weight is less than 10,000, the effect of the amorphous resin contained as the binder resin in the core together with the block polymer (hereinafter, referred to an amorphous resin for core) is too great, the image is not resistant to folding or bending, and favorable low temperature fixing property is not obtained.

The upper limit of the weight-average molecular weight of the block polymer is preferably 40,000 or less from the viewpoint of obtaining an image of high gloss, and the weight-average molecular weight of the block polymer is more preferably 13,000 to 30,000, and particularly preferably 15,000 to 25,000.

Another condition is that (2) the weight-average molecular weight of the resin for the amorphous part used in the block polymer is 1000 to 5000. If the weight-average molecular weight is less than 1000, low temperature fixing property is poor, and gloss of a formed image is lowered. If it exceeds 5000, the crystalline part is confined by the amorphous part at the time of image fixation, the speed of crystallization is slow, and therefore, image offsetting or image flaws caused by paper feed rolls after fixing occurs.

The weight-average molecular weight of the resin for the amorphous part is more preferably 2000 to 5000, and particularly preferably 2500 to 4500.

A further condition is that (3) the weight-average molecular weight of the resin for the crystalline part used in the block polymer is at least 2 times the weight-average molecular weight of the resin for the amorphous part. If the weight-average molecular weight of the resin for the amorphous part is large (for example, exceeding 5000) and the weight-average molecular weight of the resin for the crystalline part is less than 2 times that of the resin for the amorphous part, the amount of the crystalline part of block polymer is substantially insufficient, the crystalline part is confined by the amorphous part at the time of image fixation so as to be hardly crystallized, and image offsetting or image flaws caused by paper feed rolls after fixing occurs. On the other hand, if the weight-average molecular weight of the resin for the amorphous part is within the range specified in condition (2) but the weight-average molecular weight of the resin for the crystalline part is small and therefore less than 2 times that of the resin for the amorphous part, favorable low temperature fixing property cannot obtained.

The weight-average molecular weight of the resin for the crystalline part is preferably 2000 to 25000, and more preferably 5000 to 2000.

—Molecular Weight Measuring Method—

The weight-average molecular weight of the resin is measured by gel permeation chromatography (GPC). The weight-average molecular weight (Mw) is determined by using polystyrene standard. The GPC apparatus used is, for example, HLC-8120 GPC system of Toso, having TSK guard column Super H-H and TSK gel super HM-H connected in series. In a typical experiment, the GPC is performed by using tetrahydrofuran medium at the measurement temperature of 40° C. and the flow rate of 0.6 mm/min, the sample concentration is 0.5% by mass, and the analysis is performed by using the software provided in the system. In a typical experiment, as the polystyrene standard, ten samples of Toso polystyrene standard sample TSK are used: A-500, F-1, F-10, F-80, F-380, A-2500, F4, F-40, F-128, and F-700. The number-average molecular weight (Mn) can be determined similarly.

The block polymer containing a crystalline part and an amorphous part is obtained by block polymerization of the resin for crystalline part (crystalline resin) and resin for amorphous part (amorphous resin).

—Resin for Crystalline Part—

Any crystalline resin may be used for forming the crystalline part, and the melting point is preferred to be 65 to 85° C., and specifically polyester or especially aliphatic polyester is preferred. In the case of other crystalline resin, the melting point is preferred to be in a range of 65 to 85° C.

The crystalline polyester resin is a specific polyester resin synthesized from an acid (dicarboxylic acid) component and an alcohol (diol) component. In the following explanations, in the polyester resin, the constituent site which is acid component before synthesis of polyester resin is referred to "acid-derived constituent component," and the constituent site which is alcohol component before synthesis of polyester resin is referred to "alcohol-derived constituent component."

As described above, the polyester resin is a crystalline polyester resin. When the resin is not crystalline, that is, when it is amorphous, toner blocking resistance and image storability can not be maintained while better low temperature fixability is maintained.

In the invention, "crystalline" in "crystalline polyester resin" refers to not a stepwise change in endotherm but possession of a clear endothermic peak in differential scanning calorimetery (DSC). In addition, an endothermic peak refers to a peak having a width of 40 to 50° C. when formulated into a toner, in some cases. In the case of a polymer in which other component is copolymerized with the main chain of the crystalline polyester, when other component is not more than 50% by mass, this copolymer is also called crystalline polyester.

—Acid-Derived Constituent Component—

Examples of an acid which is to be the acid-derived constituent component include various dicarboxylic acids. As a main acid-derived constituent component in the specific resin, an aliphatic dicarboxylic acid and an aromatic dicarboxylic acid are desirable and, in particular, an aliphatic dicarboxylic acid is desirably a straight-chain type dicarboxylic acid.

Examples of the aliphatic dicarboxylic acid include oxalic acid, malonic acid, succinic acid, glutaric acid, adipic acid, pimelic acid, suberic acid, azelic acid, sebacic acid, 1,9-nonane dicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, 1,18-octadecanedicarboxylic acid, and 3-3'-thiodipropionic acid, and lower alkyl esters and acid-anhydrides thereof, being not limiting. Among them, in view of easy availability, sebacic acid, and 1,10-decanedicarboxylic acid are preferable.

In this invention, an aromatic dicarboxylic acid may be copolymerized. Examples of the aromatic dicarboxylic acid include terephthalic acid, isophthalic acid, orthophthalic acid, t-butylisophthalic acid, 2,6-naphthalinedicarboxylic acid and 4,4'-biphenyldicarboxylic acid. Among them, terephtalic acid, isophtalic acid, and t-butylisopthalic acid, and alkyl esters thereof are preferable in respect of easy availability, and easy formation of an easily-emulsifiable polymer. The amount of copolymerization is preferably 10 mol % or less.

In this specification, "% by constitutional mole" refers to a percentage of the acid-derived constituent component in the total acid-derived constituent components in a polyester resin, or the alcohol constituent component in the total alcohol-derived constituent components in a polyester resin, when the total acid-derived constituent components or the total alcohol-derived constituent components are defined as 1 unit (mole), respectively.

As the acid-derived constituent component, in addition to the aforementioned aliphatic dicarboxylic acid (main component)-derived constituent component and aromatic dicarboxylic acid (copolymerization component)-derived constituent component, constituent components such as a dicarboxylic acid-derived constituent component having a double bond, and a dicarboxylic acid-derived constituent component having a sulfonic acid component may be contained.

The scope of the "dicarboxylic acid-derived constituent component having a double bond" includes a constituent component derived from a lower alkyl ester or acid anhydride of a dicarboxylic acid having a double bond, in addition to a constituent component derived from a dicarboxylic acid having a double bond. The scope of the dicarboxylic acid-derived constituent component having a sulfonic acid group includes a constituent component derived from a lower alkyl ester or acid anhydride of a dicarboxylic acid having a sulfonic acid group, in addition to a constituent component derived from a dicarboxylic acid having a sulfonic acid group.

A dicarboxylic acid having a double bond can be used advantageously for preventing hot offset at fixing step because it crosslinks the whole resin by utilizing its double bond. Examples of such a dicarboxylic acid include fumaric acid, maleic acid, 3-hexenedioic acid, and 3-octenedioic acid, being not limiting. Additional examples include lower alkyl esters and acid anhydrides thereof Among them, fumaric acid and maleic acid are preferable form the viewpoint of cost.

The content of these dicarboxylic acid-derived constituent components having a double bond in all the acid-derived constituent components is preferably 10% by constitutional mole or less.

When the above-mentioned content exceeds 10% by constitutional mole, the crystallinity of the polyester resin is reduced, whereby the melting point is lowered to deteriorate the image storability in some cases.

A dicarboxylic acid having a sulfonic acid group is effective in that it can improve the dispersion state of a coloring material such as a pigment. When the whole resin is emulsified or suspended in water to prepare particles, the presence of the sulfonic acid group enables the emulsification or suspension without using a surfactant as described later. Examples of the dicarboxylic acid having a sulfonic acid group include a sodium 2-sulfoterepthalate salt, a sodium 5-sulfoisophthalate salt, and a sodium sulfosuccinate salt, being not limiting. Additional examples include lower alkyl esters and acid anhydrides of them. Among them, a sodium 5-sulfoisophthalate salt is preferable from the viewpoint of cost.

When the dicarboxylic acid-derived constituent component having a sulfonic acid group is contained in the polymer, it is preferable that the content of the constituent component derived from a dicarboxylic acid having a sulfonic acid group in all the acid-derived constituent components is 5% by constitutional mole or less. It is more preferable that the content is in the range of 3% by constitutional mole or less.

When the content exceeds 5% by constitutional mole, the hydrophilicity of the polyester resin is increased, and the charging property of the toner under high humidity may be deteriorated. Although it is not essential to use the constituent component derived from a dicarboxylic acid having a sulfonic acid group as a copolymerization component, it can be used in order to assist the emulsification of the resin.

—Alcohol-Derived Constituent Component—

As an alcohol which is to be the alcohol-derived constituent component, an aliphatic diol is preferable, and a straight-chain type aliphatic diol having a chain carbon number in the range of 7 to 20 is more preferable.

When the aliphatic diol is a branch type, the crystallinity of a polyester resin is decreased and the melting point is lowered, whereby toner blocking resistance, image storability, and lower temperature fixability are deteriorated in some cases. When the chain carbon number is less than 7, the melting point becomes higher upon polycondensation with an aromatic dicarboxylic acid, thus making low-temperature fixing difficult in some cases. On the other hand, when the chain carbon number exceeds 20, the material may be practically difficult to obtain. It is more preferable that the chain carbon number is 14 or less.

When the polyester is obtained by polycondensation of an aliphatic diol and an aromatic dicarboxylic acid, it is preferable that the chain carbon number of the aliphatic diol is an odd number. When the chain carbon number is an odd number, the melting point of the polyester resin is lower than when the chain carbon number is an even number, and the melting point can be easily adjusted to a value within the range described later.

Examples of the aliphatic diol include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,20-eicosanediol, being not limiting. Among them, in view of easy availability, ethylene glycol, 1,4-butanediol, 1,6-hexanediol, 1,9-nonanediol, and 1,10-decanediol are preferable.

In the alcohol-derived constituent component, the content of the aliphatic diol-derived constituent component is 80% by constitutional mole or more and, if necessary, other component may be contained. In the alcohol-derived constituent component, it is more preferable that the content of the aliphatic diol-derived constituent component is 90% by constitutional mole or more.

When the content of the aliphatic diol-derived constituent component is less than 80% by constitutional mole, since crystallinity of the polyester resin is deteriorated and the melting point is lowered, toner blocking resistance, image storability, and low temperature fixability may be deteriorated in some cases.

Other components which is contained as necessary include constituent components such as a diol-derived constituent component having a double bond, and a diol-derived constituent component having a sulfonic acid group. Examples of the diol having a double bond include 2-butene-1,4-diol, 3-hexene-1,6-diol, and 4-octane-1,8-diol.

The content of these diol-derived constituent components having a double bond in all the acid-derived constituent components is preferably 20% by constitutional mole or less, more preferably 2 to 10% by constitutional mole. When the content exceeds 20% by constitutional mole, the crystallinity of the polyester resin is deteriorated, the melting point is lowered, and the image storability is deteriorated in some cases.

Examples of the diol having a sulfonic acid group include a 1,4-dihydroxy-2-sulfonic acid benzene sodium salt, a 1,3-dihydroxymethyl-5-sulfonic acid benzene sodium salt, and a 2-sulfo-1,4-butanediol sodium salt.

The content of these diol-derived constituent components having a sulfonic acid group in all the acid-derived constituent components is preferably 5% by constitutional mole or less, and the minimum necessary amount is enough.

When the content exceeds 5% by constitutional mole, the hydrophilicity of the crystalline polyester resin increases, and the charging property of the toner at high temperature may be deteriorated. Although it is not necessary to use a diol-derived constituent component having a sulfonic acid group as a copolymerization component, it may be used in a minimum amount as necessary in order to assist the emulsification of the resin. Its amount, together with the amount of the dicarboxylic acid component having a sulfonic acid group, are preferably as small as possible.

When these alcohol-derived constituent components other than an aliphatic diol-derived constituent component (a diol-derived constituent component having a double bond and a diol-derived constituent component having a sulfonic acid group) is added, their content in these alcohol-derived constituent components is preferably in the range of 1 to 10% by constitutional mole.

In the invention, the ester concentration of the resin for the crystalline part is preferably 0.12 or less. The ester concentration is expressed by the following formula.

$$\text{Ester concentration}(M)=K/A$$

In the above formula, K is the number of ester groups in a polymer, and A is the number of atoms composing high molecular chain of the polymer.

When the ester concentration is 0.12 or less, the resistance of the crystalline part is kept high, the charging property is excellent at high temperature and high humidity, fogging is prevented, and high image quality is maintained for a long period. The lower limit of the ester concentration is not particularly specified; however, if the ester concentration is too low, industrial availability of materials may be low, the hydrophobicity is increased, and the adhesion to paper may be impaired. Accordingly, the ester concentration range is more preferably about 0.07 to 0.11, and still more preferably 0.08 to 0.1.

In the invention, for measuring the melting point of a crystalline polyester resin, a differential scanning calorimetry (DSC) is used, and the top value of the endothermic peaks obtained by the measurement in which the temperature is raised from room temperature to 150° C. at a temperature raising rate of 10° C. per minute is used.

—Resin for Amorphous Part—

The resin used for the formation of the amorphous part preferably has a glass transition point in the range of 40 to 70° C., and more preferably 50 to 65° C.

The glass transition point Tg is measured by using, for example, a differential scanning calorimeter (DSC3110, thermal analysis system 001 of Max Science) in the condition of a temperature rising rate of 5° C./minute. Corresponding to the obtained chart Tg, the temperature at the lower temperature side shoulder of the endothermic point is Tg.

An amorphous resin usually used in a toner can be applied directly. Specific examples include, but are not limited to polystyrene, styrene-butadiene polymer, styrene-acrylic polymer, polyester, and others. These amorphous resins may be modified by urethane, urea, or epoxy. However since polyester is preferred as the resin for the crystalline part, considering compatibility in heating, polyester is also preferred as the resin for the amorphous part.

The monomer used in the amorphous polyester resin may be any one of known divalent or trivalent or higher-valent carboxylic acids or divalent or trivalent or higher-valent alcohols, such as the monomer components listed, for example, in Polymer Data Handbook: Elementary (ed. by Japan Society of Polymer, Baifukan Publishing), the disclosure of which is incorporated by reference herein. Divalent carboxylic acids as specific examples of the monomer components include succinic acid, glutaric acid, adipic acid, suberic aid, azelaic aid, sebacid acid, phthalic acid, isophthalic acid, terephthalic acid, naphthalene-2,6-dicarboxylic acid, naphthalene-2,7-dicarboxylic acid, cyclohexane dicarboxylic acid, malonic acid, mesaconic acid, dodecenyl succinic acid, other dibasic acids, and their anhydrides and lower alkyl esters, maleic acid, fumaric acid, itaconic acid, citroconic acid, other aliphatic unsaturated dicarboxylic acids, etc. Trivalent or higher-valent carboxylic acids as specific examples of the monomer components include, for example, 1,2,4-benzene tricarboxylic acid, 1,2,5-benzene tricarboxylic acid, 1,2,4-naphthalene tricarboxylic acid, and their anhydrides and lower alkyl esters, etc. They may be used either alone or in combination of two or more types.

Divalent alcohols as specific examples of the monomer components include bisphenol A, hydrogenated bisphenol A, ethylene oxide and/or propylene oxide adduct of bisphenol A, 1,4-cyclohexane diol, 1,4-cyclohexane dimethanol, ethylene glycol, diethylene glycol, propylene glycol, dipropylene glycol, 1,3-butane diol, 1,4-butane diol, 1,5-pentane diol, 1,6-hexane diol, 1,9-nonane diol, neopentyl glycol, etc. Trivalent or higher-valent alcohols as specific examples of the monomer components include glycerine, trimethylol ethane, trimethylol propane, pentaerythritol, etc. They may be used either alone or in combination of two or more types. As required, for the purpose of adjusting the acid value or hydroxyl group value, a monovalent acid such as acetic acid or benzoic acid may be used, or a monovalent alcohol such as cyclohexanol or benzyl alcohol may be also used.

The polyester resin can be synthesized from any combination of the monomer components mentioned above, by a known method such as those described in Polycondensation (Kagaku Dojin), High Polymer Experiment (Polycondensation and polyaddition; Kyoritsu Shuppan), or Polyester Resin Handbook (Nikkan Kogyo Shimbunsha), the disclosures of which are incorporated by reference herein. The ester exchange method or direct polycondensation method may be employed either alone or in combination.

—Preparation of Block Polymer—

The block polymer containing the crystalline part and the amorphous part may be manufactured by a method selected from various methods, in consideration of reactivity of the terminal functional groups of the resins for the crystalline part and for the amorphous part. When a binder is not used, that is, in the case of a crystalline polyester and an amorphous polyester, the block polymer is obtained by promoting condensation reaction while heating and reducing pressure. In particular, when one polyester is high in acid value, and the other polyester is high in hydroxyl group value, the reaction proceeds smoothly. The reaction temperature is preferably around 200° C., and the reaction time is generally about 1 to 4 hours although the reaction time varies depending on the reaction temperature.

Even if the resin is other than polyester, when the ends of the resins for the crystalline part and amorphous part of the block polymer are a combination of an acid and an alcohol, the block polymer can be synthesized by the same method.

When using a binder, various binders can be used, and dehydration reaction or addition reaction can be conducted by using a polycarboxylic acid, a polyhydric alcohol, a polyhydric isocyanate, a multifunctional epoxy, a polyacid anhydride, etc.

In order that the weight-average molecular weight of the obtained block polymer be 10000 or more, the weight-average molecular weights of the resins for the crystalline part and amorphous part may be specified in the above range.

(Amorphous Resin for Core)

An amorphous resin (amorphous resin for the core) is used, aside from the above block polymer, as the binder resin for the toner. The amorphous resin for the core preferably have a glass transition point in the range of 50 to 70° C. (more preferably 55 to 65° C.), and an amorphous resin that is usually used in toner can be directly applied. Specific examples include, but are not limited to polystyrene, styrene-butadiene polymer, styrene-acrylic polymer, polyester, and others. These amorphous resins may be modified by urethane, urea, or epoxy. However considering compatibility in heating, polyester is preferred.

The amorphous resin for the core functions as a main binder resin, and its weight-average molecular weight is preferably 5000 to 10000, and the number-average molecular weight is preferably in the range of 2500 to 10000. If the weight-average molecular weight is less than 5000, the image strength may be lowered, and offset is likely to occur at fixing. If the weight-average molecular weight exceeds 20000, the fixing temperature may be high or the gross may be hardly elevated. A more preferred range of the weight-average molecular weight is 7000 to 17000, and a still more preferred range is 9000 to 13000.

The mixing ratio of the amorphous resin for the core and the block polymer is preferably determined based on the balance between amorphous components and crystalline components in the entire resin used in the toner (block polymer, amorphous resin for the core, amorphous resin used in the formation of the shell layer, etc.). In the entire resin, the ratio of amorphous components to crystalline components is preferably in the range of 7:3 to 9:1, and more preferably in the range of 8:2 to 8.5:1.5. When the ratio is in this range, there are advantages in that it is possible to manufacture a toner capable of being stored at high temperature and high humidity, and hardly causing blocking or filming while maintaining low temperature fixing property.

The monomer used in the amorphous polyester resin may be selected from known divalent or trivalent or higher-valent carboxylic acids or divalent or trivalent or higher-valent alcohols, such as the monomer components listed, for example, in Polymer Data Handbook: Elementary (ed. by Japan Society of Polymer, Baifukan Publishing), the disclosure of which is incorporated by reference. Specific examples of these monomer components include divalent carboxylic acids such as succinic acid, glutaric acid, adipic acid, suberic aid, azelaic aid, sebacid acid, phthalic acid, isophthalic acid, terephthalic acid, naphthalene-2,6-dicarboxylic acid, naphthalene-2,7-dicarboxylic acid, cyclohexane dicarboxylic acid, malonic acid, mesaconic acid, dodecenyl succinic acid, other dibasic acids, and their anhydrides and lower alkyl esters, maleic acid, fumaric acid, itaconic acid, citroconic acid, other aliphatic unsaturated dicarboxylic acids, etc. Specific examples of these monomer components further include trivalent or higher-valent carboxylic acids such as 1,2,4-benzene tricarboxylic acid, 1,2,5-benzene tricarboxylic acid, 1,2,4-naphthalene tricarboxylic acid, and their anhydrides and lower alkyl esters, etc. They may be used either alone or in combination of two or more types.

Examples of the divalent alcohols include bisphenol A, hydrogenated bisphenol A, ethylene oxide and/or propylene oxide adduct of bisphenol A, 1,4-cyclohexane diol, 1,4-cyclohexane dimethanol, ethylene glycol, diethylene glycol, propylene glycol, dipropylene glycol, 1,3-butane diol, 1,4-butane diol, 1,5-pentane diol, 1,6-hexane diol, 1,9-nonane diol, neopentyl glycol, etc. Examples of the trivalent or higher-valent alcohol include glycerine, trimethylol ethane, trimethylol propane, pentaerythritol, etc. They may be used either alone or in combination of two or more types. As required, for the purpose of adjusting the acid value or hydroxyl group value, a monovalent acid such as acetic acid or benzoic acid may be used, or a monovalent alcohol such as cyclohexanol or benzyl alcohol may be also used.

The polyester resin can be synthesized from any combination of the monomer components mentioned above, by a known method such as described in Polycondensation (Kagaku Dojin), High Polymer Experiment (Polycondensation and polyaddition; Kyoritsu Shuppan), or Polyester Resin Handbook (Nikkan Kogyo Shimbunsha), the disclosures of which are incorporated by reference herein. The ester exchange method or the direct polycondensation method may be employed either alone or in combination.

In the toner for electrophotography of the invention having a capsule structure, the content of the binder resin including the block polymer and the amorphous resin used in the core is preferably 60 to 90% by mass, and more preferably 70 to 80% by mass.

<Colorant>

The colorant to be used is not specified particularly, and any known colorant may be used, or proper types may be selected depending on the purpose. One colorant may be used alone, or two or more types of colorant of same system may be mixed. Or two or more types of colorants of different systems may be mixed. These colorants may be used after surface treatment.

As colorants, various pigments and dyes can be used. Specific examples are as follows. Black pigments include carbon black, copper oxide, manganese dioxide, aniline black, active carbon, nonmagnetic ferrite, magnetite, etc. Yellow pigment includes chrome yellow, sulfur yellow, yellow iron oxide, cadmium yellow, chrome yellow, Hansa yellow, Hansa yellow 10G, benzine yellow G, benzine yellow GR, surein yellow, quinoline yellow, permanent yellow NCG, etc.

Orange pigments include reddish chrome yellow, molybdenum orange, permanent orange GTR, pyrazolone orange, Balkan orange, benzidine orange G, indanthrene brilliant orange RK, indanthrene brilliant orange GK, etc. Red pigment includes iron oxide red, cadmium red, red lead, mercury sulfide, watching red, permanent red 4R, Lysol red, brilliant carmine 3B, brilliant carmine 6B, pyrazolone red, rhodamine lake B, lake red C, rose bengal, eosin red, alizaline lake, etc.

Blue pigments include Prussian blue, cobalt blue, alkaline blue lake, Victoria blue lake, fast sky blue, indanthrene blue BC, ultramarine blue, phthalocyanine blue, phthalocyanine green, etc. Violet pigment includes manganese violet, fast violet B, methyl violet lake, etc.

Green pigments include chromium oxide, chrome green, pigment green B, malachite green lake, funnel yellow green G, etc.

White pigments include zinc white, titanium oxide, antimony white, zinc sulfide, etc. Extender includes baryta powder, barium carbonate, clay, silica, white carbon, talc, alumina white, etc.

Dyes include basic, acidic, disperse, direct dyes, and various dyes, and specific examples are nigrosine, methylene blue, rose bengal, quinoline yellow, etc.

These colorants can be manufactured by preparing a dispersion of colorant particles by using a rotary shearing type homogenizer, ball mill, sand mill, attriter, other media dispersion machine, high pressure counter collision type dispersion machine, etc. These colorants can be dispersed in aqueous system with a homogenizer by using a surfactant having polarity.

The colorant used in the toner of the invention is selected from the viewpoint of hue angle, saturation, lightness, weather resistance, light fastness, OHP transparency, and dispersibility in toner. In order to assure color development at fixing, the colorant is preferably added in the range of 4% by mass to 15% by mass in the total mass of the solid content of the toner, more preferably in the range of 4% by mass to 10% by mass. However, when a magnetic material is used as a black colorant, it is preferably added in the range of 12% by mass to 48% by mass, more preferably 15 to 40% by mass.

The median diameter of the colorant particles contained in the toner is preferably in the range of 100 nm to 330 nm, more preferably 100 nm to 200 nm. By controlling the median diameter within this range, when image is formed on OFIP, transparency and color development can be assured. The median diameter of the colorant particles is measured by a laser diffraction type particle distribution counter (LA-700 of Horiba).

By properly selecting types of colorants, color toners of yellow toner, magenta toner, cyan toner, and black toner can be obtained.

<Releasing Agent>

The releasing agent is generally used for the purpose of improving the releasing property. Specific examples of the releasing agent include polyethylene, polypropylene, polybutene, other lower molecular weight polyolefins; silicones having a softening point upon heating; amide oleate, amide erucate, amide ricinoleate, amide stearate, other fatty acid amides; carnauba wax, rice wax, candelilla wax, Japan wax, beefsteak plant leaf oil, other vegetable wax; beeswax, other animal wax; montan wax, ozokerite, selesine, paraffin wax, microcrystalline wax, Fischer-Tropush wax, other mineral and petroleum wax; fatty acid ester, ester montanate, ester carboxylate, and other ester wax. In the invention, these releasing agents may be used either alone or in combination of two or more types.

In an embodiment, the releasing agent is dispersed in water together with an ionic surfactant, a high molecular acid, a higher molecular base, or other high molecular electrolytes, and heated to the melting point or higher, and is dispersed into particles of a diameter of 1 μm or less with a homogenizer having strong shearing force or with a pressure discharge type dispersion machine (Gaulin homogenizer of Gaulin), whereby a releasing agent dispersion used in aggregated particle forming process for preparing the aggregate particle dispersion is obtained. The particle size of the obtained releasing agent dispersion can be measured, for example, by using a laser diffraction particle size distribution counter (LA-700 of Horiba). The content of releasing agent is preferably 0.5 to 50% by mass in the total mass of toner particles, more preferably 1 to 30% by mass, and still more preferably 5 to 15% by mass. If the content of releasing agent is less than 0.5% by mass, there may be no effect of addition of the releasing agent. If the content of releasing agent is 50% by mass or more, when the releasing agent is exposed on the toner surface, adverse effects may occur in powder fluidity or charging property, or toner particles may be damaged in the developing device, and the releasing agent may be attached to carrier, charging is lowered and other adverse effects occur; moreover, when a color toner is used, oozing into image surface tends to be insufficient at fixing, or the releasing agent may be left over in the image when an OHP image is fixed, and transparency may be impaired.

<Other Components>

Other components which can be used in a toner for electrophotography of the invention are not particularly limited, but can be appropriately selected depending on the purpose, and examples include known various additives such as inorganic particles, organic particles, charge controlling agents, and releasing agents.

The inorganic particles are generally used for the purpose of improving flowability of a toner. Examples of the inorganic particles include particles such as silica, alumina, titanium oxide, barium titanate, magnesium titanate, calcium titanate, strontium titanate, zinc oxide, silica sand, clay, mica, wollastonite, diatomaceous earth, cerium chloride, red iron oxide, chromium oxide, cerium oxide, antimony trioxide, magnesium oxide, zirconium oxide, silicon carbide, and silicon nitride. Among them, silica particles are preferable, and hydrophobicized silica particles are particularly preferable.

The average primary particle diameter (number average particle diameter) of the inorganic particles is preferably in the range of 1 to 1,000 nm, and an addition amount (external addition) is preferably in the range of 0.01 to 20 parts by mass relative to 100 parts by mass of toner.

The organic particles are generally used for the purpose of improving cleanability and transferability and, occasionally, charging property. Examples of the organic particles include particles of polystyrene, polymethyl methacrylate, polyfluorinated vinylidene, and polystyrene-acryl copolymer.

A charge controlling agent is generally used for the purpose of improving charging property. Examples of the charge controlling agent include a salicylic acid metal salt, metal-containing azo compound, nigrosine and a quaternary ammonium salt.

<Shell>

In the toner for electrophotography of the invention, the surface of the core formed by the above-described composition is covered with a surface layer (shell). In a preferable embodiment, the shell part does not have strong effects on the dynamic properties of the entire toner, or the melt viscoelastic characteristics. If the crystalline substance is exposed on the toner surface, an externally added agent might be buried in the crystalline substance, and it could be difficult to maintain the quality. On the other hand, when the toner is thickly coated with a surface layer, the low-temperature fixing property achieved by the use of the crystalline resin is not exhibited sufficiently. Therefore, the surface layer is preferably as thin as possible, and when the surface layer is a resin layer, specifically, the thickness is preferably in the range of 0.05 to 0.5 μm. When the surface layer contains particles, their particle size is preferably 0.5 μm or less.

To form a thin surface layer whose thickness is in the range specified above, latex may be adhered or adsorbed to the surface of the core including the composition containing a binder resin, a colorant, a releasing agent, and the like, to smooth the particles, whereby a surface layer is formed.

Other preferred methods include a method of resin coating by graft polymerization by adsorbing material monomer of resin, a method of interface polymerization, and a method of treating chemically. What is preferred above all is a method that can simplify the toner preparation process as much as possible.

In the invention, it is preferable to form the resin surface layer by the emulsification aggregation coalescence method. The material of the surface layer is preferably an amorphous resin, and specific examples are same as those shown in the amorphous resin for the core, and an amorphous polyester is preferred in particular. The material group and material composition may be either same as or different from the material of the core. If the shell material is different from the core material, the difference of SP value is preferably 0.5 or less because the surface layer may not be formed if the SP value difference from the amorphous resin for the core is too much. Besides, the molecular weight and the glass transition point are preferably similar to those of the amorphous resin for the core.

The SP value of a resin is determined by the following formula based on the Fedors parameter. Or the SP value can be calculated by the following formula based on the proportions of the monomers to be used.

$$SP\ \text{value}=\sqrt{(Ev/v)}=\sqrt{(\Sigma\Delta ei/\Sigma\Delta vi)}$$

In the above formula, Ev is the evaporation energy (cal/mol), v is the molar volume ($cm^3$/mol), Δei is the evaporation energy of each atom or atomic group, and Δvi is the molar volume of each atom or atomic group.

The shell part may be fabricated by forming core aggregated particles (core), adding shell latex to aggregated particles, forming a shell, and coalescing the core and the shell.

<Manufacturing Method of Toner>

Manufacturing method of toner of the invention is described below.

A manufacturing method of toner of the invention is preferably the aggregation coalescence method, in which the shape can be easily controlled and the resin surface layer (shell) can be easily formed.

The aggregation coalescence method of the invention comprises: mixing of a colorant particle dispersion in which colorant particles are dispersed, a releasing agent particle dispersion in which a releasing agent particles are dispersed, an amorphous resin particle dispersion in which amorphous resin particles are dispersed, and a block polymer particle dispersion in which block polymer particles are dispersed; forming aggregated particle dispersion containing aggregates containing the colorant particles, the releasing agent particles, the amorphous resin particles, and the block polymer particles; adhering coating resin particles onto the surface of the aggregated particles, and heating the aggregated particles having the coating resin particles thereon to a temperature higher than the glass transition point of the resin to conduct fusing and coalescing.

In an exemplary method, a binder resin particle dispersion containing an ionic surfactant (the amorphous resin particle dispersion and the block polymer particle dispersion) is prepared generally by an emulsion polymerization method or the like, the colorant particle dispersion and the releasing agent particle dispersion are mixed therewith; in the initial stage of the mixing, the balance of amounts of ionic dispersants of each polarity is deviated preliminarily, a polymer of an inorganic metal salt such as polyaluminum chloride is added to neutralize the ionically, and then mother aggregate particles in the first stage are formed at a temperature lower than the glass transition point. After the mother aggregate particles are stabilized, an additional resin particle dispersion treated with an ionic dispersant of such polarity and amount as to compensate for the deviation of the ionic balance is added as the second stage, and further as required, the reaction system is slightly heated to a temperature below the glass transition point of the resin contained in the resin particles in the aggregated particles and in the additional resin particles to stabilize the particles at a higher temperature, and further the reaction system is heated to a temperature above the glass transition point, whereby coalescence is achieved while the additional resin particles added in the second stage of the aggregate formation are adhered to the surface of the mother aggregated particles. This progressive procedure for aggregation may be repeated plural times. By this two-stage process, the surface layer is formed, and the inclusion state of the block polymer, the releasing agent and the colorant is improved.

The surface layer (shell part) of the invention may be also formed by other methods. For example, mother aggregated particles (core part), and additional resin particle dispersion treated by freeze-dry process or the like are mixed and agitated in a mixer such as sample mill, whereby a shell layer is affixed to the core surface to form a capsule structure. Since the shell layer is affixed mechanically, the shell may peel off and drop down in the course of use for a long time in the developing device, and blocking may be induced consequently, and it is difficult to ensure high image quality for a long period. Hence, in the invention, the core and shell part is preferably formed by a wet process (e.g., the emulsion polymerization method mentioned above).

When using a vinyl monomer as the amorphous resin particles or the resin for the amorphous part in the block polymer particles, the resin particle dispersion can be prepared by emulsion polymerization by using an ionic surfactant or the like. In an embodiment in which the resin is other than the above and can dissolve in an oil-based solvent with a relatively low solubility in water, the resin is dissolved in the solvent, and then, together with an ionic surfactant or a high molecular electrolyte, is dispersed in water as particles or emulsified in the reverse phase to be dispersed in water, by using a dispersing machine such as a homogenizer. And then, the solvent is evaporated by heating or reducing pressure, so that a binder resin particle dispersion is prepared.

The crystalline resin may be dissolved and mixed in the resin particle dispersion, or mixed when manufacturing the releasing agent particle dispersion; as a result, the crystalline resin is contained in the toner.

When the releasing agent is dispersed in the toner for electrophotography, the releasing agent may be in the form of particles having a volume-average particle size in the range of 150 to 1500 nm, and the content of the releasing agent in the toner may be in the range of 1 to 25% by mass; as a result, the releasing property of the fixed image in the oilless fixing method can be enhanced. A preferred range of the volume-average particle size is 160 to 1400 nm, and the content is preferably 5 to 20% by mass.

In an embodiment, the releasing agent is dispersed in water together with an ionic surfactant, a high molecular acid, a higher molecular base, or other high molecular electrolytes, and heated over the melting point, and is pulverized by the application of strong shearing force by using a homogenizer or a pressure discharge type dispersion machine, whereby a dispersion of releasing agent particles of 1 μm or less is prepared.

The concentration of surfactant used in the releasing agent dispersion is preferably 4% by mass or less in the releasing agent. If the concentration is 4% by mass or more, the aggregation speed at particle formation is slow, and the heating time is longer, thereby disadvantageously increasing the aggregates.

When a colorant in the form of particles having a volume-average particle size of 100 to 330 nm in an amount (based on the toner) of 4 to 15% by mass is dispersed in the toner for electrophotography, the color development and OHP transparency are excellent. A preferred range of the volume-average particle size is 120 to 310 nm, and a preferred range of the content is 5 to 14% by mass.

The colorant may be dispersed by any known method, preferably using a rotary shearing type homogenizer, a ball mill, a sand mill, an attriter, a Kovor mill, or other media dispersion machines, a three-roll mill, other roll mills, a nanomizer, other cavitation mills, a colloid mill, a high pressure counter collision type dispersion machine or the like.

In the manufacturing method of toner of the invention, various surfactants may be used in emulsion polymerization of the binder resin particles, dispersion of the colorant, addition and dispersion of additional resin particles, dispersion of the releasing agent, and their aggregation and stabilization. Specific examples of the surfactants include ester sulfates, sulfonates, ester phosphates, soap system anionic surfactants, amine salts, quaternary ammonium salts, and other cationic surfactants. It is also effective to use additionally a nonionic surfactant such as polyethylene glycol-based surfactant, an alkylphenol ethylene oxide adduct-based surfactant, a polyhydric alcohol-based surfactant. The surfactant may be dispersed by a generally-used means such as a rotary shearing homogenizer, a media ball mill, a sand mill, or a dyno mill.

When using colorant particles coated with polar resin particles, for example, the resin and the colorant are dissolved and dispersed in a solvent (water, surfactant, alcohol, etc.), and dispersed in water together with a proper dispersant as mentioned above (containing an active agent), and heated. Then, the pressure is reduced to remove the solvent to form colorant particles coated with polar resin particles. As alternatives, the colorant particles may be fixed, by mechanical shearing force or electrical adsorbing force, to the surface of the resin particles manufactured by emulsion polymerization. These methods are effective for suppressing the release of the colorant added to aggregated particles, or for improving the colorant dependence of the charge property.

After fusing and coalescing, a desired toner is obtained through the process of arbitrary cleaning step, solid-liquid separating step, and drying step. In the cleaning step, the cleaning is preferably conducted sufficiently by replacement washing with ion exchange water in order to express and maintain the charge property. The solid-liquid separation step is not particularly specified, but from the viewpoint of productivity, it is preferable to employ suction filtration, pressurized filtration, centrifugal filtration, decanter, etc. The drying step is not particularly specified, but from the viewpoint of productivity, it is preferable to employ air passing drying device, spray drying device, rotary drying device, air stream drying device, fluidized bed drying device, conduction heat type drying device, freeze-drying device, etc.

For the purpose of imparting fluidity or improving cleaning property, similarly to the manufacture of ordinary toners, it is effective to add, to toner surface by shearing force in the dry state, a metal salt such as calcium carbonate, a metal oxide compound such as silica, alumina, titania, barium titanate, strontium titanate, calcium titanate, cerium oxide, zirconium oxide, or magnesium oxide, inorganic particles such as ceramics or carbon black, resin particles such as vinyl resin, polyester, or silicone.

These inorganic particles are preferably surface treated by a coupling agent or the like in order to control the charge property or the like. Examples of the coupling agent include silane coupling agents (e.g., methyl trichlorosilane, methyl dichlorosilane, dimethyl dichlorosilane, trimethyl chlorosilane, phenyl trichlorosilane, diphenyl dichlorosilane, tetramethoxy silane, methyl trimethoxy silane, dimethyl dimethoxy silane, phenyl trimethoxy silane, diphenyl dimethoxy silane, tetraethoxy silane, methyl triethoxy silane, dimethyl diethoxy silane, phenyltriethoxy silane, diphenyl diethoxy silane, isobutyl trimethoxy silane, decyl trimethoxy silane, hexamethyl silazane, N,N-(bistrimethyl silyl)acetamide, N,N-bis(trimethyl silyl)urea, tertbutyldimethyl chlorosilane, vinyl trichlorosilane, vinyl trimethoxy silane, vinyl trie-ethoxy silane, γ-methacryloxy propyl trimethoxy silane, β-(3,4 epoxy cyclohexyl)ethyl trimethoxy silane, γ-glycidoxy pripyl trimethoxy silane, γ-glycidoxy pripyl methyl diethoxy silane, γ-mercaptopropyl trimethoxy silane, γ-chloropropyl trimethoxy silane), and titanium coupling agents.

Particles may be added by adhering the particles to the toner surface in dry process by using a mixer such as a V-blender or a HENSCHEL mixer after drying of the toner, or by dispersing particles in an aqueous liquid such as water or water/alcohol mixture, adding the dispersion to the toner in a slurry state, and then drying the toner to allow the external additive to be present on the toner surface. As an alternative, particles may be added by spraying the slurry to the dry powder followed by drying.

—Shape Factor SF1—

The shape factor SF1 of the toner of the invention thus manufactured is preferably 100 to 140, more preferably 110 to 135.

The shape factor SF1 is determined as follows. Toner is sprinkled over slide glass, and observed by an optical microscope, and its image is picked up by a video camera, and taken into an image analyzer (LUZEX III, manufactured by Nireco), whereby the maximum length (ML) and projection area (A) of 50 toner particles are measured, and SF1 is calculated by the following formula.

$$SF1=(ML^2/A)\times(100\times\pi)/4$$

The shape factor SF1 is used as an index for expressing the toner shape and figures, and is based on a statistic technique of image analysis in which the area, length and shape of toner particles can be determined and analyzed at high precision from the optical microscopic image. The value is closer to 100 when the shape of toner particles is closer to spherical shape, and a larger value is obtained when the shape is slender or long. That is, the shape factor SF1 shows the difference between the maximum diameter and minimum diameter of toner particles, and is an index showing distortion. If the toner shape is a complete sphere, SF1 is 100.

If SF1 exceeds 140, aggregation force among toner particles is increased, and transfer failure may occur.

In a method for confirming whether the toner for electrophotography obtained by the means mentioned above satisfies the following three conditions: (1) the weight-average molecular weight of the block polymer is 10000 or more, (2) the weight-average molecular weight of the resin for the amorphous part of the block polymer is 1000 to 5000, and (3) the weight-average molecular weight of the resin for the crystalline part of the block polymer is at least twice the weight-average molecular weight of the resin for the amorphous part, the resin for the crystalline part and the resin for the amorphous part are separated from the toner composition, and the weight-average molecular weights thereof are measured by using GPC as mentioned above. The separating means may be a method of dissolving the amorphous resin in a solvent such as ethyl acetate or toluene, and separating the crystalline resin.

<Developer for Electrophotography>

The developer of the invention is not particularly specified as far as the toner of the invention is contained, and a proper chemical composition may be used depending on the purpose. The developer of the invention is either a one-component developer containing toner alone, or a two-component developer containing toner and carrier.

The carrier is not particularly limited, and any known carrier may be used whose example is the resin coated carrier disclosed in JP-A Nos. 62-39879 or 56-11461, the disclosures of which are incorporated by reference herein.

Specific examples of the carrier include the following resin coated carriers. The nuclear particles of the carrier may be ordinary iron powder, ferrite, or magnetite forming, and the volume-average particle size is about 30 to 200 μm.

Examples of the coating resin of the resin coated carrier include homopolymers and copolymers of: styrenes such as styrene, parachlorostyrene, and α-methyl styrene; α-methylene fatty acid monocarboxylates such as methyl acrylate, ethyl acrylate, n-propyl acrylate, lauryl acrylate, 2-ethylhexyl acrylate, methyl methacrylate, n-propyl methacrylate, lauryl methacrylate, and 2-ethylhexy methacrylate; acryls containing nitrogen such as dimethyl aminoethyl methacrylate; vinyl nitriles such as acrylonitrile and methacrylonitrile; vinyl pyridines such as 2-vinyl pyridine and 4-vinyl pyridine; vinyl ethers such as vinyl methyl ether and vinyl isobutyl ether; vinyl ketones such as vinyl methyl ketone, vinyl ethyl ketone, and vinyl isopropenyl ketone; olefins such as ethylene and propylene; and vinyl monomers containing fluorine such as vinylidene fluoride, tetrafluoroethylene, and hexafluoroethylene. Examples of the coating resin further include silicone resins such as methyl silicone or methylphenyl silicone, polyester resins containing bisphenol or glycol, epoxy resins, polyurethane resins, polyamide resins, cellulose resins, polyether resins, polycarbonate resins, etc. These resins may be used either alone or in combination of two or more types. The coating amount of the coating resin is preferably about 0.1 to 10 parts by mass in 100 parts by mass of the nuclear particles, more preferably 0.5 to 3.0 parts by mass.

The carrier may be manufactured by using a heating type kneader, a heating type HENSCHEL mixer, a UM mixer, etc., or, depending on the amount of coating resin, a heating type fluidized rolled bed or a heating type kiln.

In the developer of the invention, the mixing ratio between the toner and carrier is not particularly limited, and may be properly selected depending on the purpose.

<Image Forming Method>

Image forming method of the invention is described.

The image forming method of the invention comprises: forming an electrostatic latent image on a surface of a latent image holding member, developing, by using of a developer carried on a developer carrier, the electrostatic latent image formed on the surface of the latent image holding member to form a toner image, transferring the toner image formed on the surface of the latent image holding member onto a surface of a transfer receiving material, and thermally fixing the toner image transferred onto the surface of the transfer receiving material, in which the developer is a developer containing the toner of the invention. The developer is either a one-component developer or a two-component developer.

Each process may be conducted by a known process in image forming methods.

The latent image holding member is, for example, an electrophotographic photoreceptor or a dielectric recording member. In the case of an electrophotographic photoreceptor, the surface of the electrophotographic photoreceptor is uniformly charged by a Collotron charger or a contact charger, and exposed, and an electrostatic latent image is obtained (latent image forming step). Then, the photoreceptor is brought into contact with, or brought to near the developing roll whose surface has a developer layer, whereby toner particles adhere to the electrostatic latent image to form a toner image on the electrophotographic photoreceptor (developing step). The toner image thus formed is transferred to the surface of a transfer receiving material such as paper by making use of a Collotron charger or the like (transferring step). Further, the toner image transferred onto the transfer receiving material surface is heated and fixed by a fixing device, thereby forming a final toner image.

Upon heating and fixing by the fixing device, a releasing agent is usually supplied to the fixing member in the fixing device so as to prevent offset or the like.

The method of supplying a releasing agent onto the surface of a roller or belt as fixing member used in heating and fixing is not particularly limited, and examples include a pad method using a pad impregnated with a liquid releasing agent, a web method, a roller method, a contact-free shower method (spray method), etc. In particular, the web method of roller method is preferred. In these methods, the releasing agent can be supplied uniformly, and the supply amount can be controlled. When supplying the releasing agent uniformly on the entire fixing member by the shower method, a blade should be used additionally.

The transfer receiving material (recording material) to which the toner image is transferred may be plain paper or OHP sheet used in electrophotographic copier or printer.

Hereinafter, preferable modes of the invention are listed. However, the invention is not necessarily limited to these modes.

[1] A toner for electrophotography having a capsule structure comprising a core and a shell that covers the core, wherein the core contains a colorant, a releasing agent, an amorphous resin, and a block polymer containing a crystalline part and an amorphous part, the weight-average molecular weight of the block polymer is 10,000 or more, the weight-average molecular weight of the resin used in formation of the amorphous part of the block polymer is 1000 to 5000, and the weight-average molecular weight of the resin used in formation of the crystalline part of the block polymer is at least 2 times the weight-average molecular weight of the resin used in formation of the amorphous part of the block polymer.

[2] A toner for electrophotography described in [1], wherein the resin used in formation of the crystalline part is an aliphatic crystalline polyester having an ester concentration of 0.12 or less as expressed in formula (1):

$$\text{Ester concentration}(M)=K/A \qquad \text{Formula 1}$$

wherein K is a number of ester groups in a polymer, and A is a number of atoms composing a polymer chain of the polymer.

[3] A toner for electrophotography described in the preferred mode [2], wherein the melting point of the resin used in formation of the crystalline part is 65 to 85° C.

[4] A toner for electrophotography described in the preferred mode [2], wherein an acid-derived constituent component of the resin used in formation of the crystalline part contains a dicarboxylic acid having a double bond.

[5] A toner for electrophotography described in the preferred mode [4], wherein the content of the dicarboxylic acid-derived component having a double bond is 10% by constitutional mole or less in the total acid-derived component.

[6] A toner for electrophotography described in the preferred mode [1], wherein the resin forming the amorphous part is an amorphous polyester having a glass transition point of 40 to 70° C.

[7] A toner for electrophotography described in the preferred mode [6], wherein the resin forming the amorphous part is an amorphous polyester having a glass transition point of 50 to 70° C.

[8] A toner for electrophotography described in the preferred mode [1], wherein the shell includes an amorphous polyester.

[9] A toner for electrophotography described in the preferred mode [8], wherein the film thickness of the shell is 0.05 to 0.5 μm.

[10] A toner for electrophotography described in the preferred mode [8], wherein the SP value difference between the amorphous resin of the core and a resin of the shell is 0.5 or less.

[11] A toner for electrophotography described in the preferred mode [1], wherein the content of the releasing agent is 0.5 to 50% by mass with respect to the total toner.

[12] A toner for electrophotography described in the preferred mode [1], wherein the ratio by mass of an amorphous component to a crystalline component in the entire resin used in the toner is from 7:3 to 9:1.

[13] A toner for electrophotography described in the preferred mode [1], wherein the shape factor SF1 of the toner is 100 to 140.

[14] A manufacturing method of toner for electrophotography comprising:

forming aggregated particles by mixing a colorant particle dispersion, a releasing agent particle dispersion, an amorphous resin particle dispersion, and a block polymer particle dispersion in which particles of a block polymer containing a crystalline part and an amorphous part are dispersed, adhering coating resin particles to the surface of the aggregated particles, and fusing by heating the aggregate particles to which the coating resin particles are adhered, wherein the toner for electrophotography is the toner for electrophotography described in the preferred mode [1].

[15] A developer for electrophotography comprising a toner for electrophotography and a carrier, wherein the toner for electrophotography has a capsule structure comprising a core and a shell that covers the core, the core contains a colorant, a releasing agent, an amorphous resin, and a block polymer containing a crystalline part and an amorphous part, the weight-average molecular weight of the block polymer is 10,000 or more, the weight-average molecular weight of the resin used in formation of the amorphous part of the block polymer is 1000 to 5000, and the weight-average molecular weight of the resin used in formation of the crystalline part of the block polymer is at least 2 times the weight-average molecular weight of the resin used in formation of the amorphous part of the block polymer.

[16] A developer for electrophotography described in the preferred mode [15], wherein the carrier is coated with a resin, and the coating amount of the resin is 0.1 to 10% by mass of the entire carrier.

[17] An image forming method comprising:

forming an electrostatic latent image on a surface of a latent image holding member, developing, by use of a developer carried on a developer carrier, the electrostatic latent image formed on the surface of the latent image holding member to form a toner image, transferring the toner image formed on the surface of the latent image holding member onto a surface of a transfer receiving material, and fixing the toner image transferred onto the surface of the transfer receiving material, wherein the developer is the developer for electrophotography described in the preferred mode [15].

EXAMPLES

The present invention is more specifically described below by reference to specific examples. Unless otherwise noted, in the example, "parts" and "%" represents "parts by mass" and "% by mass", respectively.

<Synthesis of Block Polymer (1)>

241 parts of dodecane diacid, 174 parts of 1,10-decane diol, and 0.08 part of dibutyl tin oxide are put in a flask whose internal air has been displaced by nitrogen, and are allowed to react for 4 hours at 170° C., and further for 4 hours at 210° C. at reduced pressure, to form crystalline polyester (1) having a weight-average molecular weight (Mw) of 13000, a number-average molecular weight of 5900, a melting point of 79° C., and an ester concentration of 0.083.

Then, 97 parts of dimethyl terephthalate, 78 parts of dimethyl isophthalate, 27 parts of anhydrous dodecenyl succinate, 174 parts of bisphenol A-ethylene oxide adduct, 189 parts of bisphenol A-propylene oxide adduct, and 0.08 part of dibutyl tin oxide are put in a flask whose internal air has been displaced by nitrogen, and are allowed to react for 4 hours at 150° C., and further for 2 hours at 200° C. at reduced pressure, to form amorphous polyester (1) having a weight-average molecular weight (Mw) of 3500, a number-average molecular weight of 1700, and a glass transition point (Tg) of 58° C.

400 parts of crystalline polyester (1) as a resin for the crystalline part, and 100 parts of amorphous polyester (1) as a resin for the amorphous part are put in a flask, and are allowed to react for 2 hours at 200° C. under nitrogen stream, and further for 2 hours at reduced pressure, to form 490 parts of block polymer (1) having a weight-average molecular weight (Mw) of 16500 and a number-average molecular weight of 7000.

<Synthesis of Block Polymer (2)>

241 parts of dodecane diacid, 160 parts of 1,9-nonane diol, and 0.08 part of dibutyl tin oxide are put in a flask whose internal air has been displaced by nitrogen, and are allowed to react for 4 hours at 170° C., and further for 4 hours at 210° C. at reduced pressure, to form crystalline polyester (2) having a weight-average molecular weight (Mw) of 12000, a number-average molecular weight of 5100, a melting point of 73° C., and an ester concentration of 0.087.

400 parts of crystalline polyester (2) as a resin for the crystalline part, and 100 parts of amorphous polyester (1) as a resin for the amorphous part are put in a flask, and are allowed to react for 2 hours at 200° C. under nitrogen stream, and further for 2 hours at reduced pressure, to form 490 parts of block polymer (2) having a weight-average molecular weight (Mw) of 15400 and a number-average molecular weight of 6600.

<Synthesis of Block Polymer (3)>

62 parts of 3,3'-thiodipropionic acid, 173 parts of dodecane diacid, 174 parts of 1,10-decane diol, and 0.08 part of dibutyl tin oxide are put in a flask whose internal air has been displaced by nitrogen, and are allowed to react for 4 hours at 170° C., and further for 4 hours at 210° C. at reduced pressure, to form crystalline polyester (3) having a weight-average molecular weight (Mw) of 11000, a number-average molecular weight of 5000, a melting point of 74° C., and an ester concentration of 0.088.

Then, 97 parts of dimethyl terephthalate, 78 parts of dimethyl isophthalate, 27 parts of anhydrous dodecenyl succinate, 111 parts of bisphenol A-ethylene oxide adduct, 249 parts of bisphenol A-propylene oxide adduct, and 0.08 part of dibutyl tin oxide are put in a flask whose internal air has been displaced by nitrogen, and are allowed to react for 4 hours at 150° C., and further for 2 hours at 200° C. at reduced pressure, to form amorphous polyester (2) having a weight-average molecular weight (Mw) of 3300, a number-average molecular weight of 1500, and a glass transition point (Tg) of 59° C.

400 parts of crystalline polyester (3) as a resin for the crystalline part, and 100 parts of amorphous polyester (2) as a resin for the amorphous part are put in a flask, and are allowed to react for 2 hours at 200° C. under nitrogen stream, and further for 2 hours at reduced pressure, to form 490 parts of block polymer (3) having a weight-average molecular weight (Mw) of 14200 and a number-average molecular weight of 6200.

<Synthesis of Block Polymer (4)>

241 parts of dodecane diacid, 174 parts of 1,10-decane diol, and 0.08 part of dibutyl tin oxide are put in a flask whose internal air has been displaced by nitrogen, and are allowed to react for 4 hours at 170° C., and further for 4 hours at 210° C. at reduced pressure, to form crystalline polyester (4) having a weight-average molecular weight (Mw) of 15000, a number-average molecular weight of 6300, a melting point of 81° C., and an ester concentration of 0.083.

400 parts of crystalline polyester (4) as a resin for the crystalline part, and 100 parts of amorphous polyester (2) as a resin for the amorphous part are put in a flask, and are allowed to react for 2 hours at 200° C. under nitrogen stream, and further for 2 hours at reduced pressure, to form 490 parts of block polymer (4) having a weight-average molecular weight (Mw) of 18300 and a number-average molecular weight of 7200.

<Synthesis of Block Polymer (5)>

230 parts of dodecane diacid, 90 parts of 1,4-butane diol, and 0.08 part of dibutyl tin oxide are put in a flask whose internal air has been displaced by nitrogen, and are allowed to react for 4 hours at 170° C., and further for 4 hours at 210° C. at reduced pressure, to form crystalline polyester (5) having a weight-average molecular weight (Mw) of 8000, a number-average molecular weight of 4000, a melting point of 72° C., and an ester concentration of 0.11.

400 parts of crystalline polyester (5) as a resin for the crystalline part, and 100 parts of amorphous polyester (1) as a resin for the amorphous part are put in a flask, and are allowed to react for 2 hours at 200° C. under nitrogen stream, and further for 2 hours at reduced pressure, to form 490 parts of block polymer (5) having a weight-average molecular weight (Mw) of 11400 and a number-average molecular weight of 5100.

<Synthesis of Block Polymer (6)>

153 parts of adipinic acid, 118 parts of 1,6-hexane diol, and 0.08 part of dibutyl tin oxide are put in a flask whose internal air has been displaced by nitrogen, and are allowed to react for 4 hours at 170° C., and further for 4 hours at 210° C. at reduced pressure, to form crystalline polyester (6) having a weight-average molecular weight (Mw) of 12000, a number-average molecular weight of 5600, a melting point of 65° C., and an ester concentration of 0.143.

400 parts of crystalline polyester (6) as a resin for the crystalline part, and 100 parts of amorphous polyester (1) as a resin for the amorphous part are put in a flask, and are allowed to react for 2 hours at 200° C. under nitrogen stream, and further for 2 hours at reduced pressure, to form 490 parts of block polymer (6) having a weight-average molecular weight (Mw) of 15400 and a number-average molecular weight of 6700.

<Synthesis of Block Polymer (7)>

97 parts of dimethyl terephthalate, 78 parts of dimethyl isophthalate, 27 parts of anhydrous dodecenyl succinate, 164 parts of bisphenol A-ethylene oxide adduct, 179 parts of bisphenol A-propylene oxide adduct, and 0.08 part of dibutyl tin oxide are put in a flask whose internal air has been displaced by nitrogen, and are allowed to react for 4 hours at 150° C., and further for 4 hours at 200° C. at reduced pressure, to form amorphous polyester (3) having a weight-average molecular weight (Mw) of 8000, a number-average molecular weight of 3500, and a glass transition point (Tg) of 62° C.

160 parts of crystalline polyester (1) as a resin for the crystalline part, and 260 parts of amorphous polyester (3) as a resin for the amorphous part are put in a flask, and are allowed to react for 2 hours at 200° C. under nitrogen stream, and further for 2 hours at reduced pressure, to form 410 parts of block polymer (7) having a weight-average molecular weight (Mw) of 21400 and a number-average molecular weight of 7600.

<Synthesis of Block Polymer (8)>

253 parts of dodecane diacid, 174 parts of 1,10-decane diol, and 0.08 part of dibutyl tin oxide are put in a flask whose internal air has been displaced by nitrogen, and are allowed to react for 4 hours at 170° C., and further for 0.5 hour at 210° C. at reduced pressure, to form crystalline polyester (8) having a weight-average molecular weight (Mw) of 3700, a number-average molecular weight of 1800, a melting point of 78° C., and an ester concentration of 0.83.

200 parts of crystalline polyester (8) as a resin for the crystalline part, and 200 parts of amorphous polyester (1) as a resin for the amorphous part are put in a flask, and are allowed to react for 1 hour at 200° C. under nitrogen stream, and further for 2 hours at reduced pressure, to form 390 parts of block polymer (8) having a weight-average molecular weight (Mw) of 7000 and a number-average molecular weight of 3000.

<Synthesis of Amorphous Polyester for Core (4)>

97 parts of dimethyl terephthalate, 78 parts of dimethyl isophthalate, 27 parts of anhydrous dodecenyl succinate, 95 parts of bisphenol A-ethylene oxide adduct, 240 parts of bisphenol A-propylene oxide adduct, and 0.08 part of dibutyl tin oxide are put in a flask whose internal air has been displaced by nitrogen, and are allowed to react for 4 hours at 150° C., and further for 6 hours at 200° C. at reduced pressure, to form amorphous polyester (4) having a weight-average molecular weight (Mw) of 12000, a number-average molecular weight of 5500, and a glass transition point (Tg) of 63° C.

<Synthesis of Amorphous Polyester for Shell (5)>

97 parts of dimethyl terephthalate, 97 parts of dimethyl isophthalate, 221 parts of bisphenol A-ethylene oxide adduct, 234 parts of bisphenol A-propylene oxide adduct, and 0.08 part of dibutyl tin oxide are put in a flask whose internal air has been displaced by nitrogen, and are allowed to react for 4 hours at 150° C., and further for 6 hours at 200° C. at reduced pressure, to form amorphous polyester (5) having a weight-average molecular weight (Mw) of 12300, a number-average molecular weight of 5600, and a glass transition point (Tg) of 62° C.

<Preparation of Pigment Dispersion>

The following composition is mixed and dissolved, and dispersed by a homogenizer (ULTRA TURRAX T50, manufactured by IKA) and ultrasonic irradiation, to form a blue pigment dispersion having a volume-average particle size of 150 nm.

Cyan pigment C.I. Pigment Blue 15:3 (copper phthalocyanine, Dainippon Ink and Chemicals): 50 parts Anionic surfactant NEOGEN SC (manufactured by Daiichi Kogyo Seiyaku): 5 parts Ion exchange water: 200 parts <Preparation of Releasing Agent Dispersion>

The following composition is mixed, heated to 97° C., and dispersed by a homogenizer (ULTRA TURRAX T50 manufactured by IKA). Subsequently, the dispersion is subjected to a further dispersing by Gaulin homogenizer (manufactured by Meiwa Shoji) (treatment for 20 times in the conditions of 105° C. and 550 kg/cm$^2$), thereby forming a releasing agent dispersion having a volume-average particle size of 190 nm.

Wax (WEP-5, manufactured by NOF corporation): 25 parts

Anionic surfactant NEOGEN SC (manufactured by Daiichi Kogyo Seiyaku): 5 parts

Ion exchange water: 200 parts

Example 1

<Preparation of Latexes>

60 parts of block polymer (1) is dissolved in 300 parts of ethyl acetate, and 3 parts of anionic surfactant (sodium dodecyl benzene sulfonate) is added thereto together with 300 parts of ion exchange water. The mixture is heated to 55° C., and is agitated by using an emulsion machine (ULTRA TURRAX T-50 of IKA) for 10 minutes at 8000 rpm, and then ethyl acetate is evaporated to form block polymer latex (1) having a volume-average particle size of 230 nm.

The volume-average particle size is measured (in the case the particle diameter is less than 2 μm) with a laser diffraction particle size distribution counter (LA-700, Horiba). In the measurement, a sample in the dispersion state is adjusted to a solid content of about 2 g, and ion exchange water is added to adjust the volume to about 40 ml. The solution is charged into a cell to a proper concentration, and the particle size is measured when the concentration in cell is almost stabilized (i.e., about 2 minutes after the charging into the cell). The volume-average particle sizes obtained in each channel are accumulated from the smaller size, and the particle size at which the cumulative volume reaches 50% is assumed as the volume-average particle size.

60 parts of amorphous polyester (4) is dissolved in 300 parts of ethyl acetate, and 3 parts of an anionic surfactant (sodium dodecyl benzene sulfonate) is added together with 300 parts of ion exchange water. The mixture is heated to 55° C., and is agitated by an emulsion machine (ULTRA TURRAX T-50 of IKA) for 10 minutes at 8000 rpm, and then ethyl acetate is evaporated to form amorphous polyester latex (4) having a volume-average particle size of 230 nm.

60 parts of amorphous polyester (5) is dissolved in 300 parts of ethyl acetate, and 3 parts of an anionic surfactant (sodium dodecyl benzene sulfonate) is added together with 300 parts of ion exchange water. The mixture is heated to 55° C., and is agitated by an emulsion machine (ULTRA TURRAX T-50 of IKA) for 10 minutes at 8000 rpm, and then ethyl acetate is evaporated to form amorphous polyester latex (5) having a volume-average particle size of 230 nm.

<Preparation of Toner (1)>

The following composition is mixed and dispersed by a homogenizer (ULTRA TURRAX T50 of IKA) in a round stainless steel flask, and the mixed solution in the flask is stirred and heated to 45° C., and is held for 30 minutes at 45° C.

Block polymer latex (1): 150 parts
Amorphous polyester latex (4): 360 parts
Ion exchange water: 300 parts
Pigment dispersion: 25 parts
Releasing agent dispersion: 90 parts
10% aluminum polychloride aqueous solution (manufactured by Asada Chemical): 1.5 parts The obtained content is observed under an optical microscope, and the growth of aggregated particles of about 6.2 μm in diameter is recognized.

Then, 90 parts of amorphous polyester latex (5) is adjusted to pH 3, and added to the mixed solution above, and the temperature is gradually raised to 55° C. The obtained content is observed under an optical microscope, and the growth of aggregated particles of about 6.5 μm in diameter is recognized. The pH is adjusted to 8 with a sodium hydroxide aqueous solution, the temperature is raised to 90° C., and the aggregated particles are allowed to undergo a coalescence process for about 1 hour, and cooled and filtered. Then, the particles are sufficiently cleaned with ion exchange water, and dried to form toner (1).

The shape factor SF1 of this toner (1) is measured by the method described above, and found to be 135.

The particle sizes are measured by a COULTER COUNTER, and the volume-average particle size is found to be 6.5 μm, and the volume GSD, which is an index of volume-average particle size distribution, is found to be 1.23. The volume GSD and volume-average particle size (in the case of particle diameter of 2 μm or more) are measured by using a COULTER COUNTER TA-II (Beckmann-Coulter), and the electrolyte is ISOTON-II (Beckmann-Coulter). In the method of measurement, 0.5 to 50 mg of sample is put in 2 ml of a 5% aqueous solution of a surfactant (sodium alkylbenzene sulfonate) as a dispersant. This sample solution is added to 100 ml of the electrolyte. The electrolyte suspending the sample is subjected to a dispersing treatment for about 1 minute in a ultrasonic dispersion machine, and measured by the COULTER COUNTER TA-II, so that the particle size distribution of particles of 2 to 60 μm is measured by using an aperture of 100 μm in diameter, and the volume-average distribution and the number-average distribution are determined. A total of 50,000 particles are measured.

The toner particle size distribution is measured in the following method. The measured particle sizes are divided into size ranges (channels), and the volume cumulative distribution is plotted from the smaller size, and cumulative volume particle size at cumulative 16% is define as D16v, the cumulative volume particle size at cumulative 50% is define as D50v, and the cumulative volume particle size at cumulative 84% is define as D84v. The volume-average particle size is D50v, and a small-size side volume-average particle size index GSDv is calculated as follows.

$$GSDv=\{(D84V)/(D16V)\}^{0.5}$$

In the particles of this toner, external additives are added as follows: 0.5% of silica having an average particle size of 40 nm treated with hexamethyl disilazane, and 0.7% of a titanium compound (average particle size 30 nm) obtained by treating methatitanic acid with 50% of isobutyl trimethoxy silane followed by baking, are added to the toner and mixing is conducted for 10 minutes with a 75L HENSCHEL mixer (the amounts are based on the toner mass). The mixture is sieved by a wind sieving machine HIGH BOLTER 30 (manufactured by Shin Tokyo Kikai) to form a toner provided with external additives.

Further, onto 100 parts of ferrite core with an average particle size of 50 μm, 0.15 part of vinylidene fluoride and 1.35 parts of a methyl methacrylate-trifluoroethylene copolymer (polymerization ratio 80:20) resin are coated by using a kneader, to form a carrier. The obtained carrier and the toner provided with the external additives are blended in a ratio of 100 parts: 8 parts by a 2-liter V-blender, thereby forming a developer (1).

[Evaluation]

(Evaluation of Low Temperature Fixing Property)

The prepared developer (1) is tested in DOCUCENTRE COLOR 500 modified model of Fuji Xerox (in which the fixing is conducted by an external fixing device that can vary the fixing temperature), and an image is formed on Fuji Xerox color paper (J paper) while adjusting the toner loading to 13.5 g/m$^2$. The image is fixed by the external fixing device with a nip width of 6.5 mm at a fixing speed of 180 mm/sec. To evaluate the minimum fixing temperature, the image is fixed at various temperatures: i.e., the temperature of the fixing roll of the external fixing device is increased from 90° C. in increments of +5° C. The paper carrying the image formed at each fixing temperature is folded inside nearly in the center of the solid portion of the fixed toner image, and the portion in which the fixed toner image is broken is wiped by tissue paper, and the blank line width is measured. The minimum temperature giving the line width of 0.5 mm or less is defined as the minimum fixing temperature (MFT). The results are shown in Table 1.

(Measurement of Charge Amount)

The prepared developer (1) is let stand for 24 hours in the environment of 28° C. and 85% RH, and then agitated for 60 minutes by a TURBULA mixer manufactured by Turbula, and the toner charge amount is measured by a blow-off tribo device (TB-200, macufactured by Toshiba Chemical). The results are shown in Table 1.

(Evaluation of Blocking)

The prepared developer (1) is used for the formation of a print test chart image with an image density of 1% on 10000 sheets of Fuji Xerox color paper (J paper) by using the modified model of DOCUCENTRE COLOR 500 manufactured by Fuji Xerox in the environment of 28° C. and 85% RH. The fixing temperature is 30° C. higher than the minimum fixing temperature (MFT) obtained above. After printing on 10000 sheets, occurrence of white stripes in solid portion of the image is observed. The toner is taken out of the developing device, and the blocked toner is observed visually. As a result of these observations, the blocking resistance is evaluated according to the following criterion. The results are shown in Table 1.

A: no white stripes, almost no blocked toner in developing device.

B: no white stripes, toner slightly blocked in developing device.

C: slight white stripes, toner somewhat blocked in developing device.

D: obvious white stripes, toner apparently blocked in developing device.

(Evaluation of Toner Preservativeness)

After forming images on the 10000 sheets above (evaluation of blocking), the surface of the toner remaining in the developing device is observed by an electron microscope. A total of 100 toner particles are observed, and toner particles with peeled shell and broken toner particles are counted, and the toner storability is evaluated according to the following criterion. The results are shown in Table 1.

A: no toner particle with peeled shell or breakage.

B: 1 or 2 toner particles with peeled shell or breakage.

C: 3 to 5 toner particles with peeled shell or breakage.

D: 10 or more toner particles with peeled shell or breakage.

(Evaluation of Fixing Property)

After forming images on the 10000 sheets above (evaluation of blocking), the surface of the fixed image is visually observed, and the presence or absence of mark stripes produced by a paper feed roll is evaluated according to the following criterion. The results are shown in Table 1.

A: almost no roll mark stripes

B: slight roll mark stripes

C: obvious roll mark stripes (Evaluation of Filming)

After forming images on the 10000 sheets above (evaluation of blocking), deposits on the photoreceptor are visually observed, and evaluated according to the following criterion. The results are shown in Table 1.

A: no deposits observed on the photoreceptor.

B: slight deposits observed on the photoreceptor.

C: slight linearly grown deposits observed on the photoreceptor.

D: deposits observed on almost the entire photoreceptor.

Example 2

A latex is prepared in the same manner as in example 1, except that block polymer (2) is used instead of block polymer (1), and toner (2) is obtained. A developer is prepared and evaluated in the same manner as in example 1. The evaluatetion results are shown in Table 1.

Example 3

A latex is prepared in the same manner as in example 1, except that block polymer (3) is used instead of block polymer (1), and toner (3) is obtained. A developer is prepared and evaluated in the same manner as in example 1. The evaluation results are shown in Table 1.

Example 4

A latex is prepared in the same manner as in example 1, except that block polymer (3) is used instead of block polymer (1). Toner (4) is manufactured by the following method.

The following composition in a round stainless steel flask is mixed and dispersed by a homogenizer (ULTRA TURRAX T50 of IKA), and the mixed solution in the flask is stirred and heated to 45° C., and held for 30 minutes at 45° C.

Block polymer latex (4): 225 parts

Amorphous polyester latex (4): 285 parts

Ion exchange water: 300 parts

Pigment dispersion: 25 parts

Releasing agent dispersion: 90 parts

10% polyaluminum chloride aqueous solution (Asada Chemical): 1.5 parts

The obtained content is observed under an optical microscope, and the growth of aggregated particles with a particle size of about 6.2 μm is noted.

After adjusting the pH of 90 parts of amorphous polyester latex (5) to 3, it is added to the mixed solution above, and gradually heated to 55° C. The obtained content is observed under an optical microscope, and the growth of aggregate particles with a particle size of about 6.5 μm is noted. After adjusting the pH to 8 with a sodium hydroxide aqueous solution, the temperature is raised to 90° C., and aggregates are allowed to undergo coalescing process for about 1 hour. Then, the particles are cooled, filtered, washed sufficiently with ion exchange water, and dried to form toner (4).

Thereafter, a developer is prepared and evaluated in the same manner as in example 1. The results are shown in Table 1.

Example 5

A latex is prepared in the same manner as in example 1, except that block polymer (5) is used instead of block polymer (1), and toner (5) is obtained. A developer is prepared and evaluated in the same manner as in example 1. The evaluation results are shown in Table 1.

Example 6

A latex is prepared in the same procedure as in example 1, except that block polymer (6) is used instead of block polymer (1), and toner (6) is obtained. Developer is prepared in the same procedure as in example 1, and evaluated. Results are shown in Table 1.

Comparative Example 1

A latex is prepared in the same manner as in example 1, except that block polymer (7) is used instead of block polymer (1), and toner (7) is obtained. A developer is prepared and evaluated in the same manner as in example 1. The evaluation results are shown in Table 2.

Comparative Example 2

A latex is prepared in the same manner as in example 1, except that block polymer (8) is used instead of block polymer (1), and toner (8) is obtained. A developer is prepared and evaluated in the same manner as in example 1. The evaluation results are shown in Table 2.

Comparative Example 3

A latex is prepared in the same manner as in example 1, except that block polymer (4) is used instead of block polymer (1). Toner (9) is manufactured by the following method.

The following composition in a round stainless steel flask is mixed and dispersed by a homogenizer (ULTRA TURRAX T50 of IKA), and the mixed solution in the flask is stirred and heated to 45° C., and held for 30 minutes at 45° C.

Block polymer latex (4): 150 parts

Amorphous polyester latex (4): 450 parts

Ion exchange water: 300 parts

Pigment dispersion: 25 parts

Releasing agent dispersion: 90 parts

10% polyaluminum chloride aqueous solution (Asada Chemical): 1.5 parts

The obtained content is observed under an optical microscope, and the growth of aggregated particles with a particle size of about 6.2 μm is noted.

The obtained mixed solution is gradually heated to 55° C. The obtained content is observed under an optical microscope, and the growth of aggregated particles with a particle size of about 6.5 μm is noted. After adjusting the pH to 8 with a sodium hydroxide aqueous solution, the temperature is raised to 90° C., and aggregates are allowed to undergo coalescence process for about 1 hour, and then cooled, filtered, washed sufficiently with ion exchange water, and dried to form toner (9).

Thereafter, a developer is prepared and evaluated in the same manner as in example 1. The evaluation results are shown in Table 2.

Comparative Example 4

A latex is prepared in the same manner as in example 1, except that block polymer (4) is used instead of block polymer (1). Toner (10) is manufactured by the following method.

The following composition in a round stainless steel flask is mixed and dispersed by a homogenizer (ULTRA TURRAX T50 of IKA), and the mixed solution in the flask is stirred and heated to 45° C., and held for 30 minutes at 45° C.

Crystalline polyester latex (4): 150 parts

Amorphous polyester latex (4): 390 parts

Ion exchange water: 300 parts

Pigment dispersion: 25 parts

Releasing agent dispersion: 90 parts

10% polyaluminum chloride aqueous solution (Asada Chemical): 1.5 parts

The obtained content is observed under an optical microscope, and the growth of aggregated particles with a particle size of about 6.3 μm is noted.

After adjusting the pH of 90 parts of amorphous polyester latex (5) to 3, it is gradually heated to 55° C. The obtained content is observed under an optical microscope, and the growth of aggregate particles of particle size of about 6.6 μm is noted. After adjusting the pH to 8 with a sodium hydroxide aqueous solution, the temperature is raised to 90° C., and aggregates are allowed to undergo coalescence process for about 1 hour, and then cooled, filtered, washed sufficiently with ion exchange water, and dried to form toner (10).

Thereafter, a developer is prepared and evaluated in the same manner as in example 1. The evaluation results are shown in Table 2.

TABLE 1

| | Example 1 Toner (1) | Example 2 Toner (2) | Example 3 Toner (3) | Example 4 Toner (4) | Example 5 Toner (5) | Example 6 Toner (6) |
|---|---|---|---|---|---|---|
| Block polymer | Block polymer (1) | Block polymer (2) | Block polymer (3) | Block polymer (4) | Block polymer (5) | Block polymer (6) |
| Block polymer Mw | 16500 | 15400 | 14200 | 18300 | 11400 | 15400 |
| Resin for crystalline part Mw | 13000 | 12000 | 11000 | 15000 | 8000 | 12000 |
| Resin for amorphous part Mw | 3500 | 3500 | 3300 | 3300 | 3500 | 3500 |
| Ester concentration of resin for crystalline part | 0.083 | 0.087 | 0.088 | 0.083 | 0.11 | 0.143 |
| Resin for amorphous part Tg (° C.) | 58 | 58 | 59 | 59 | 58 | 58 |
| Amorphous resin for core | Amorphous polyester (4) | Amorphous polyester (4) | Amorphous polyester (4) | Amorphous polyester (4) | Amorphous polyester (4) | Amorphous polyester (4) |
| Amorphous resin for shell | Amorphous polyester (5) | Amorphous polyester (5) | Amorphous polyester (5) | Amorphous polyester (5) | Amorphous polyester (5) | Amorphous polyester (5) |
| Ratio of crystalline component/amorphous component | 80/20 | 80/20 | 80/20 | 70/30 | 80/20 | 80/20 |
| Toner SF1 | 135 | 132 | 130 | 134 | 128 | 128 |
| Toner volume-average particle size (μm) | 6.5 | 6.7 | 6.6 | 6.5 | 6.4 | 6.5 |
| Volume GSD | 1.23 | 1.22 | 1.22 | 1.24 | 1.22 | 1.22 |
| MFT(° C.) | 105 | 100 | 100 | 105 | 100 | 100 |
| Charge amount (μC/g) | 45 | 39 | 38 | 38 | 35 | 27 |
| Blocking | A | A | A | A | A | B |
| Toner preservativeness | A | A | A | A | A | B |
| Fixing property | A | A | A | A | A | A |
| Filming | A | A | A | A | A | C |

TABLE 2

| | Comparative Example 1 Toner (7) | Comparative Example 2 Toner (8) | Comparative Example 3 Toner (9) | Comparative Example 4 Toner (10) |
|---|---|---|---|---|
| Block polymer | Block polymer (7) | Block polymer (8) | Block polymer (4) | Block polymer (4) |
| Block polymer Mw | 21400 | 7000 | 18300 | — |
| Resin for crystalline part Mw | 13000 | 3700 | 15000 | 15000 |
| Resin for amorphous part Mw | 8000 | 3500 | 3300 | — |
| Ester concentration of resin for crystalline part | 0.083 | 0.083 | 0.083 | 0.083 |
| Resin for amorphous part Tg (° C.) | 62 | 58 | 59 | — |
| Amorphous resin for core | Amorphous polyester (4) | Amorphous polyester (4) | Amorphous polyester (4) | Amorphous polyester (4) |
| Amorphous resin for shell | Amorphous polyester (5) | Amorphous polyester (5) | None | Amorphous polyester (5) |
| Ratio of crystalline component/amorphous component | 80/20 | 80/20 | 80/20 | 80/20 |
| Toner SF1 | 138 | 132 | 129 | 215 |
| Toner volume-average particle size (μm) | 6.6 | 6.5 | 6.8 | 6.6 |
| Volume GSD | 1.22 | 1.23 | 1.25 | 1.23 |
| MFT(° C.) | 105 | 115 | 105 | 115 |
| Charge amount (μC/g) | 45 | 43 | 43 | 40 |
| Blocking | A | B | D | A |
| Toner preservativeness | A | B | D | A |
| Fixing property | C | A | A | A |
| Filming | B | B | D | C |

As shown in Tables 1 and 2, all toners in examples can maintain the image quality for a long period, being excellent in storage at high temperature, almost free from blocking in the developing device or filming on the photoreceptor, and capable of fixing the image at high gross at low temperature. The toner in comparative example 1 is high in molecular weight of the resin for the amorphous part, and causes roll marks. The toner in comparative example 2 is low in molecular weight of the block polymer, and although the toner is fixed on paper, the image is damaged by folding, and the minimum fixing temperature (MFT) is slightly higher, and is it not suited to fixing at low temperature. The toner in comparative example 3 has no shell layer, and blocking in the developing device or filming on the photoreceptor is likely to occur, and images of high quality are not obtained stably. The toner in comparative example 4 has no block polymer, and the minimum fixing temperature (MFT) is high, and low temperature fixing property is poor.

The toner in example 6 uses a resin of low ester concentration in the crystalline part, and as compared with toners of other examples, charging property at high temperature and high humidity is slightly inferior, and plasticization occurs, and the toner is likely to be left over on the photoreceptor, and filming resistance is slightly inferior.

As is clear from these results, the toners of the examples are found to maintain the image quality for a long period, being excellent in storage at high temperature, and almost free from blocking in the developing device or filming on the photoreceptor.

The invention provides a toner for electrophotography capable of obtaining high image quality for a long period, while maintaining an excellent low temperature fixing property, a method of manufacturing the same toner, a developer for electrophotography using the same toner, and an image forming method using the same developer.

What is claimed is:

1. A toner for electrophotography having a capsule structure comprising a core and a shell that covers the core, wherein the core contains a colorant, a releasing agent, an amorphous resin, and a block polymer containing a crystalline part and an amorphous part, the weight-average molecular weight of the block polymer is 10,000 or more, the weight-average molecular weight of the resin used in formation of the amorphous part of the block polymer is 1000 to 5000, and the weight-average molecular weight of the resin used in formation of the crystalline part of the block polymer is at least 2 times the weight-average molecular weight of the resin used in formation of the amorphous part of the block polymer, and wherein the resin used in formation of the crystalline part of the block copolymer is an aliphatic crystalline polyester having an ester concentration of 0.12 or less as expressed in formula (1):

$$\text{Ester concentration}(M)=K/A \qquad \text{(Formula (1))}$$

wherein K is a number of ester groups in a polymer, and A is a number of atoms composing a polymer chain of the polymer.

2. The toner for electrophotography of claim 1, wherein the melting point of the resin used in formation of the crystalline part is 65 to 85° C.

3. The toner for electrophotography of claim 1, wherein an acid-derived constituent component of the resin used in formation of the crystalline part contains a dicarboxylic acid having a double bond.

4. The toner for electrophotography of claim 3, wherein the content of the dicarboxylic acid-derived component having a double bond is 10% by constitutional mole or less in the total acid-derived component.

5. The toner for electrophotography of claim 1, wherein the resin forming the amorphous part is an amorphous polyester having a glass transition point of 40 to 70° C.

6. The toner for electrophotography of claim 5, wherein the resin forming the amorphous part is an amorphous polyester having a glass transition point of 50 to 70° C.

7. The toner for electrophotography of claim 1, wherein the shell includes an amorphous polyester.

8. The toner for electrophotography of claim 7, wherein the film thickness of the shell is 0.05 to 0.5.mu.m.

9. The toner for electrophotography of claim 7, wherein the SP value difference between the amorphous resin of the core and a resin of the shell is 0.5 or less.

10. The toner for electrophotography of claim 1, wherein the content of the releasing agent is 0.5 to 50% by mass with respect to the total toner.

11. The toner for electrophotography of claim 1, wherein the ratio by mass of an amorphous component to a crystalline component in the entire resin used in the toner is from 7:3 to 9:1.

12. The toner for electrophotography of claim 1, wherein the shape factor SF1 of the toner is 100 to 140.

13. A manufacturing method of toner for electrophotography comprising: forming aggregated particles by mixing a colorant particle dispersion, a releasing agent particle dispersion, an amorphous resin particle dispersion, and a block polymer particle dispersion in which particles of a block polymer containing a crystalline part and an amorphous part are dispersed, adhering coating resin particles to the surface of the aggregated particles, and fusing by heating the aggregate particles to which the coating resin particles are adhered, wherein the toner for electrophotography is the toner for electrophotography of claim 1.

14. A developer for electrophotography comprising a toner for electrophotography and a carrier, wherein the toner for electrophotography has a capsule structure comprising a core and a shell that covers the core, the core contains a colorant, a releasing agent, an amorphous resin, and a block polymer containing a crystalline part and an amorphous part, the weight-average molecular weight of the block polymer is 10,000 or more, the weight-average molecular weight of the resin used in formation of the amorphous part of the block polymer is 1000 to 5000, and the weight-average molecular weight of the resin used in formation of the crystalline part of the block polymer is at least 2 times the weight-average molecular weight of the resin used in formation of the amorphous part of the block polymer, and wherein the resin used in formation of the crystalline part of the block copolymer is an aliphatic crystalline polyester having an ester concentration of 0.12 or less as expressed in formula (1):

$$\text{Ester concentration}(M)=K/A \qquad \text{(Formula (1))}$$

wherein K is a number of ester groups in a polymer, and A is a number of atoms composing a polymer chain of the polymer.

15. The developer for electrophotography of claim 14, wherein the carrier comprises a nuclear particle coated with a resin, and the coating amount of the resin is 0.1 to 10% by mass of the nuclear particle.

16. An image forming method comprising: forming an electrostatic latent image on a surface of a latent image holding member, developing, by use of a developer carried on a developer carrier, the electrostatic latent image formed on the surface of the latent image holding member to form a toner image, transferring the toner image formed on the surface of the latent image holding member onto a surface of a transfer receiving material, and fixing the toner image transferred onto the surface of the transfer receiving material, wherein the developer is the developer for electrophotography of claim 14.

* * * * *